US009919169B2

(12) United States Patent
Lewinski et al.

(10) Patent No.: US 9,919,169 B2
(45) Date of Patent: Mar. 20, 2018

(54) INTEGRATED CARGO FIRE-SUPPRESSION AGENT DISTRIBUTION SYSTEM

(75) Inventors: Daniel F. Lewinski, Stanwood, WA (US); Oliver C. Meier, Lynnwood, WA (US)

(73) Assignee: The Boeing Company, Chicago, IL (US)

( * ) Notice: Subject to any disclaimer, the term of this patent is extended or adjusted under 35 U.S.C. 154(b) by 634 days.

(21) Appl. No.: 12/852,480

(22) Filed: Aug. 7, 2010

(65) Prior Publication Data

US 2012/0031634 A1 Feb. 9, 2012

(51) Int. Cl.

| | |
|---|---|
| ***A62C 3/08*** | (2006.01) |
| ***A62C 35/02*** | (2006.01) |
| ***A62C 35/62*** | (2006.01) |
| ***A62C 37/44*** | (2006.01) |

(52) U.S. Cl.

CPC ..... *A62C 3/08* (2013.01); *A62C 35/62* (2013.01); *A62C 37/44* (2013.01)

(58) Field of Classification Search

CPC .. A62C 3/07; A62C 3/08; A62C 35/02; A62C 3/00; A62C 3/06; A62C 37/44; A62C 35/62; A62C 31/22; A62C 99/009; A62C 31/05; A62C 3/04; A62C 31/03

USPC ..... 169/62, 70, 56, 60, 16

See application file for complete search history.

(56) References Cited

U.S. PATENT DOCUMENTS

| | | | | |
|---|---|---|---|---|
| 3,465,827 | A * | 9/1969 | Levy et al. | 169/61 |
| 4,351,394 | A * | 9/1982 | Enk | 169/61 |
| 4,726,426 | A * | 2/1988 | Miller | 169/62 |
| 5,038,867 | A * | 8/1991 | Hindrichs et al. | 169/62 |
| 5,211,246 | A * | 5/1993 | Miller et al. | 169/62 |
| 6,003,608 | A * | 12/1999 | Cunningham | 169/46 |
| 6,491,254 | B1 * | 12/2002 | Walkinshaw et al. | 244/118.5 |
| 2005/0263298 | A1 | 12/2005 | Kotliar | |
| 2008/0064316 | A1 | 3/2008 | Ng | |
| 2010/0236796 | A1 * | 9/2010 | Chattaway et al. | 169/46 |

OTHER PUBLICATIONS

Extended European Search Report mailed on Jan. 11, 2012.

* cited by examiner

*Primary Examiner* — Chee-Chong Lee

(74) *Attorney, Agent, or Firm* — McDonnell Boehnen Hulbert & Berghoff LLP

(57) ABSTRACT

An integrated cargo-fire-suppression agent distribution system is disclosed. The integrated cargo-fire-suppression agent distribution system comprises a shut-off valve operable to close such that an airflow is blocked, and vehicle ventilation means operable to distribute a fire-suppression agent if the airflow is blocked.

15 Claims, 5 Drawing Sheets

INTEGRATED CARGO FIRE-SUPPRESSION AGENT DISTRIBUTION SYSTEM

FIELD

Embodiments of the present disclosure relate generally to fire suppression. More particularly, embodiments of the present disclosure relate to fire suppression methods usable for fire-suppression agent distribution.

BACKGROUND

Fire suppression may refer to a use of agents such as gases, liquids, solids, chemicals and mixtures thereof to extinguish combustion. Fire suppression systems may use a "total flooding" or a "non-total flooding" method to apply an extinguishing agent in an enclosed volume. The total flooding or the non-total flooding method may achieve a concentration of the extinguishing agent as a volume percent to air of the extinguishing agent sufficient to suppress or extinguish a fire. Use of environmentally friendly fire-suppression agents such as environmentally friendly chemical agents or inert gases are being encouraged as a replacement for Halon in fire suppression systems. However, some of these gaseous systems may require significantly higher volumetric flow rates and thereby systems with higher volume and weight than existing Halon-type fire-suppression agent delivery systems. In airplane operations, higher volume can occupy cargo volume and increased weight is undesirable since fuel burn rates increase accordingly.

SUMMARY

An integrated cargo-fire-suppression agent distribution system is disclosed. The integrated cargo-fire-suppression agent distribution system comprises vehicle ventilation means operable to distribute a fire-suppression agent or an airflow.

In a first embodiment, an aircraft integrated cargo-fire suppression-agent distribution system comprises a shut-off valve operable to close such that an airflow is blocked. The system also comprises vehicle ventilation means operable to distribute a fire-suppression agent if the airflow is blocked.

In a second embodiment, an integrated cargo fire-suppression agent distribution method provides vehicle ventilation means comprising at least one fire-suppression supply source. The method also distributes a fire-suppression agent from the at least one fire-suppression supply source using the vehicle ventilation means.

In a third embodiment, an integrated cargo fire-suppression agent distribution method closes a shut-off valve to block an airflow. The method also distributes a fire-suppression agent instead of the airflow.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures.

The figures are provided to facilitate understanding of the disclosure without limiting the breadth, scope, scale, or applicability of the disclosure. The drawings are not necessarily made to scale.

DETAILED DESCRIPTION

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. Furthermore, there is no intention to be bound by any expressed or implied theory presented in the preceding field, background, summary or the following detailed description. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to fire suppression techniques, fire suppressants, ventilation systems, and other functional aspects of the systems (and the individual operating components of the systems) may not be described in detail herein. In addition, those skilled in the art will appreciate that embodiments of the present disclosure may be practiced in conjunction with a variety of structural bodies, and that the embodiments described herein are merely example embodiments of the disclosure.

Embodiments of the disclosure are described herein in the context of a practical non-limiting application, namely, aviation cargo hold fire suppression. Embodiments of the disclosure, however, are not limited to such aviation cargo hold applications, and the techniques described herein may also be utilized in other fire suppression applications. For example but without limitation, embodiments may be applicable to truck cargo hold fire suppression, train cargo hold fire suppression, ship cargo hold fire suppression, and the like.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

Figure 1:
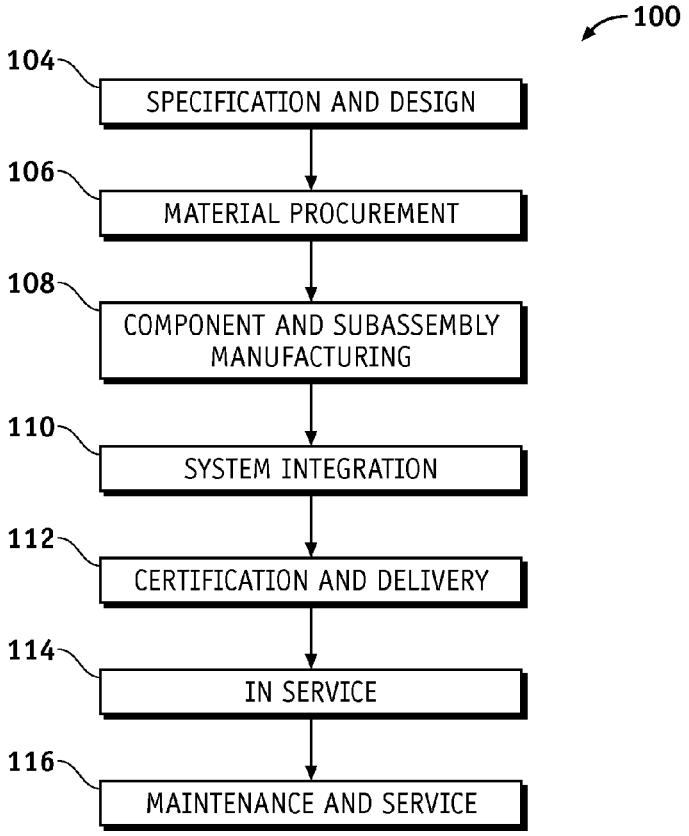
FIG. 1 is an illustration of a flow diagram of an exemplary aircraft production and service methodology.
Figure 2:
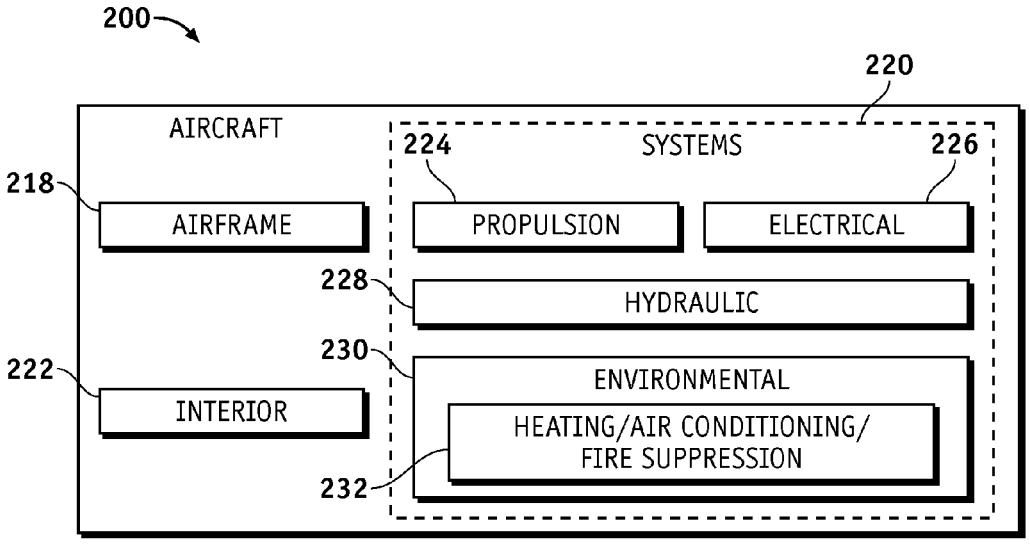
FIG. 2 is an illustration of an exemplary block diagram of an aircraft.

Referring more particularly to the drawings, embodiments of the disclosure may be described in the context of an aircraft manufacturing and service method 100 as shown in FIG. 1 and an aircraft 200 as shown in FIG. 2. During pre-production, the exemplary method 100 may include specification and design 104 of the aircraft 200 and material procurement 106. During production, component and subassembly manufacturing 108 and system integration 110 of the aircraft 200 takes place. Thereafter, the aircraft 200 may go through certification and delivery 112 in order to be placed in service 114. While in service by a customer, the aircraft 200 is scheduled for routine maintenance and service 116 (which may also include modification, reconfiguration, refurbishment, and so on).

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be without limitation an airline, leasing company, military entity, service organization, and the like.

As shown in FIG. 2, the aircraft 200 produced by the exemplary method 100 may include an airframe 218 with a plurality of systems 220 and an interior 222. Examples of high-level systems 220 include one or more of a propulsion system 224, an electrical system 226, a hydraulic system 228, and an environmental system 230 comprising an air conditioning/fire suppression system 232 (dual-mode conditioned air/fire-suppression agent distribution system). Any number of other systems may also be included. Although an aerospace example is shown, the embodiments of the disclosure may be applied to other industries.

Apparatus and methods embodied herein may be employed during any one or more of the stages of the production and service method 100. For example, components or subassemblies corresponding to production process 108 may be fabricated or manufactured in a manner similar to components or subassemblies produced while the aircraft 200 is in service. In addition, one or more apparatus embodiments, method embodiments, or a combination thereof may be utilized during the production stages 108 and 110, for example, by substantially expediting assembly of or reducing the cost of an aircraft 200. Similarly, one or more of apparatus embodiments, method embodiments, or a combination thereof may be utilized while the aircraft 200 is in service, for example and without limitation, to maintenance and service 116.

For cargo fire suppression, a cargo fire-suppression agent Halon 1301 has generally been distributed into a cargo compartment (cargo bay) via dedicated distribution systems. Such dedicated distribution systems are generally optimized for flow rates that discharge Halon 1301 in a high pressure liquid for a High Rate Discharge, and in a gaseous phase for a Low Rate (or metered) Discharge. In an aircraft application, each cargo compartment may have its own dedicated distribution system comprising tubes routed to nozzles in the cargo bay. The nozzles may be mounted in pans down the centerline of the cargo bay ceiling liner. Fire suppression systems may be operated automatically by an automatic detection and control mechanism, manually by manual activation of an actuator via a remote switch, a combination thereof, and the like.

Use of environmentally friendly fire-suppression agents such as environmentally friendly gaseous agents are being encouraged as a replacement for Halon. However, gas discharge volumes for these non-Halon type of suppression system may require a much higher discharge rate than volumes of both the liquid and the gaseous discharges of Halon 1301. Current Halon-type systems may be limited to low volumetric flow rates of about 150 cubic feet per minute (cfm). Systems that can rely on environmentally friendly gaseous agents or inert gases may require significantly higher volumetric flow rates, on an order of 2000-3000 cfm for an approximate 5000 cubic foot compartment volume, which may be beyond the capability of existing Halon-type fire-suppression agent delivery systems. Embodiments of the disclosure provide a fire suppression system comparable in size and weight to Halon 1301 fire suppression systems that can be used with Halon-type and/or non-Haylon-type fire-suppression agents.

Embodiments of the disclosure use a dual-mode conditioned air/fire-suppression agent distribution system that utilizes a ventilation system, for example but without limitation, a cargo air conditioning system, a cargo heat system, and the like. The dual-mode conditioned air/fire-suppression agent distribution system distributes a high volume rate fire-suppression agent (e.g., a high volume rate gas) throughout a cargo bay or other unoccupied contained volume (e.g., a non-passenger carrying compartment) to suppress a fire within that compartment or the contained volume. In this manner, a need for a redundant distribution system is eliminated by having one network that provides both conditioned air under normal operation to provide conditioned air to the cargo compartment or contained volume and inert gas or suppression agent when a fire/smoke is detected within the cargo compartment or contained volume. In this manner, fire-suppression agent distribution system weight is reduced which is desirable to minimize fuel burn rates in airplane operations. Furthermore, a higher volumetric flow rate of fire-suppression agent may be introduce into the protected volume (cargo compartment or control volume) than is generally provided by existing fire-suppression agent discharge networks.

Architectures according to embodiments of the disclosure allow for higher volumetric flow rates of fire-suppression agent to be transported into a cargo bay. The system is dual use, during normal operation the system allows conditioned air to flow into the cargo compartment to provide heating, cooling or ventilation. In an event of a fire, the system ceases to be used for ventilation and is used to transport a fire-suppression agent into the cargo bay. This is different from existing solutions, which rely on two separate sets of ducting and tubing to transport conditioned air and fire-suppression agent respectively to the cargo bay. In this manner, embodiments of the disclosure provide for cost savings through reduced part count, installation time and weight avoidance.

Figure 3:
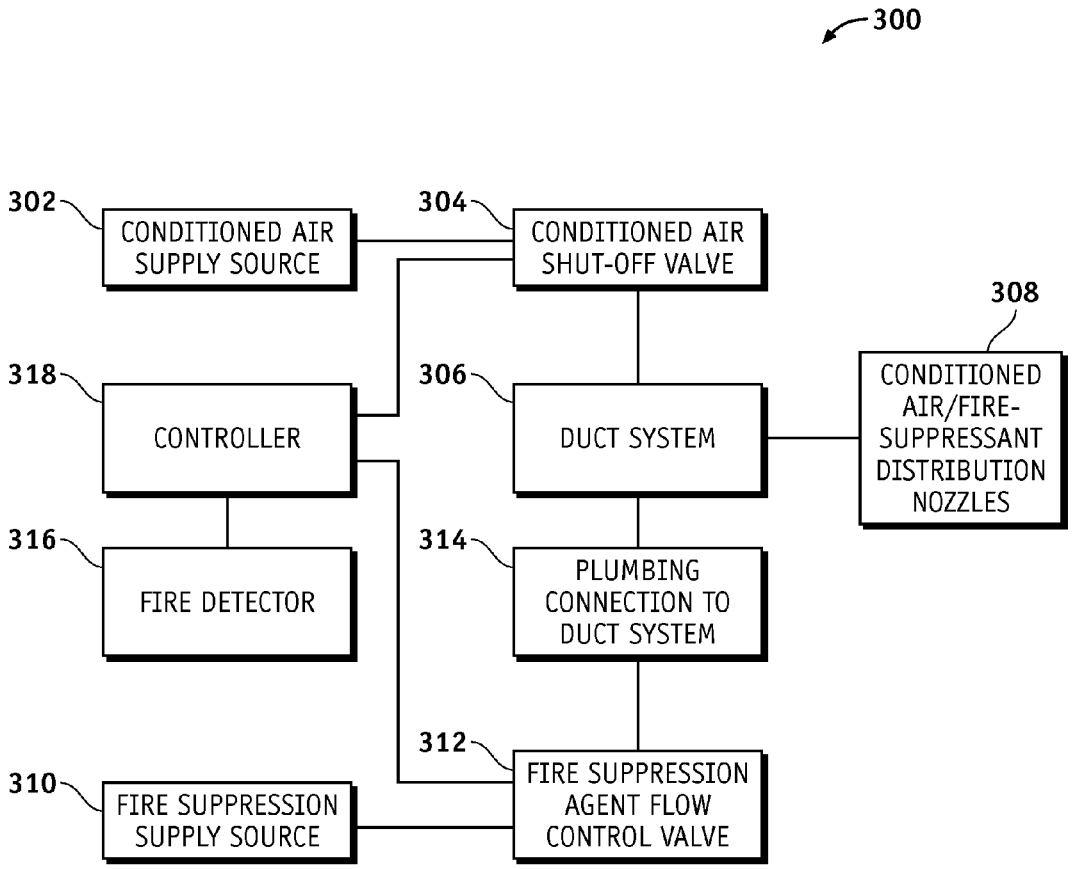
FIG. 3 is an illustration of an exemplary schematic block diagram of a dual-mode conditioned air/fire-suppression agent distribution system according to an embodiment of the disclosure.

FIG. 3 is an illustration of an exemplary schematic block diagram of a dual-mode conditioned air/fire-suppression agent distribution system 300 according to an embodiment of the disclosure. The dual-mode conditioned air/fire-suppression agent distribution system 300 is an integrated cargo fire-suppression agent distribution system. The dual-mode conditioned air/fire-suppression agent distribution system 300 comprises a conditioned air supply source 302, a conditioned air shut-off valve 304, a duct system 306, one or more distribution nozzles 308, at least one fire-suppression agent supply source 310, a fire-suppression agent flow-control valve 312, a plumbing connection 314, a fire/smoke detector 316, and a controller 318.

The conditioned air supply source 302 is coupled to the duct system 306 through the conditioned air shut-off valve 304 and is configured to supply conditioned air to the duct system 306. The conditioned air may comprise, for example but without limitation, cooled or heated air from an air conditioning system, heated air from a cargo heat-distribution system, bleed air from an engine compressor, dehumidified air, disinfected air, and the like.

The conditioned air shut-off valve 304 is coupled to the conditioned air supply source 302 and the duct system 306, and is configured to shut-off a flow of conditioned air from the conditioned air supply source 302 when directed by the controller 318 as explained in more detail below. The conditioned air shut-off valve 304 is operable to be in an open position to allow a flow of the conditioned air to the duct system 306, or to be in a closed position to block substantially all of the flow of the conditioned air to the duct system 306. The conditioned air shut-off valve 304 changes from the open position to the closed position in response to receiving a signal from the controller 318 as explained below. In some embodiments, the conditioned air shut-off valve 304 remains in the closed position until reset during maintenance. For example, in an aircraft operation, the conditioned air shut-off valve 304 may be reset by a maintenance crew to the open position after landing in preparation for the next flight. In other embodiments, the conditioned air shut-off valve 304 may change from the closed position to the open position in response to receiving a signal from the controller 318. The conditioned air shut-off valve 304 may be actuated via an actuator, a gear mechanism, and/or in conjunction with one or more components of the system 300, and the like. In certain embodiments, the conditioned air shut-off valve 304 is electronically actuated. Any actuator known to those skilled in the art may be used for actuation of the conditioned air shut-off valve 304, for example but without limitation, a hydraulic actuator, a piezoelectric actuator, a spring loaded mechanism, a reverse flow blocking mechanism, a pyrotechnic actuator, and the like.

The duct system 306 is coupled to: the conditioned air supply source 302 through the conditioned air shut-off valve 304; the fire-suppression agent supply source 310 through the fire-suppression agent flow-control valve 312 and the plumbing connection 314; and the distribution nozzles 308. The duct system 306 transports conditioned air or fire-suppression agent to the distribution nozzles 308 from the conditioned air supply source 302 or the fire-suppression agent supply source 310 respectively.

Figure 5:
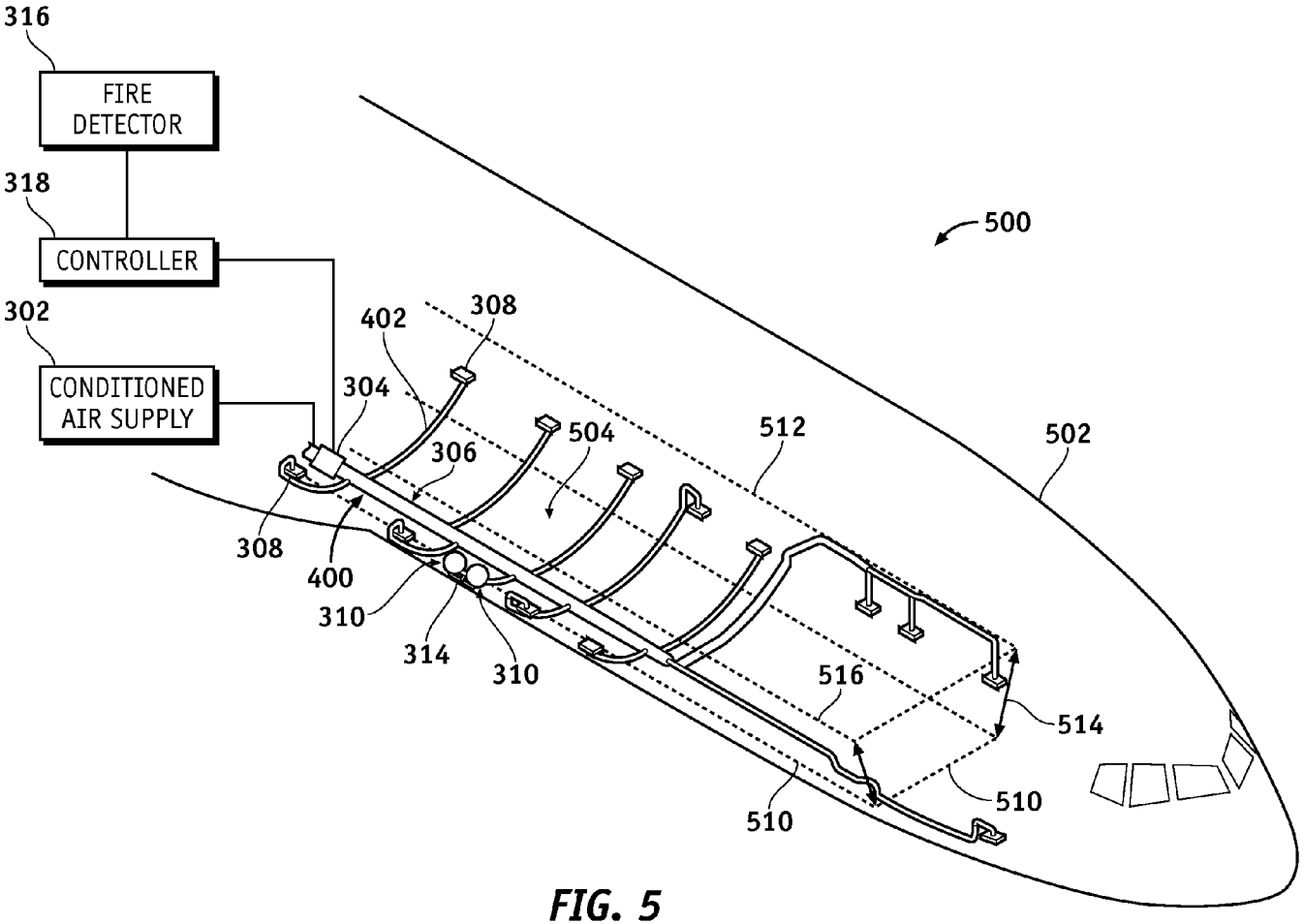
FIG. 5 is an illustration of an exemplary structure of an aircraft cargo compartment comprising a dual-mode conditioned air/fire-suppression agent distribution system according to an embodiment of the disclosure.

The distribution nozzles 308 are coupled to the duct system 306 and are configured to distribute conditioned air or fire-suppression agent into a contained volume such as a cargo volume 504 (FIG. 5). The distribution nozzles 308 may be mounted in sidewalls, floor, ceilings or other locations of the cargo volume 504 (FIG. 5).

The fire-suppression agent supply source 310 is configured to transport a fire-suppression agent into the duct system 306 to suppress a fire in the contained volume such as the cargo volume 504. The fire-suppression agent may be delivered by, for example but without limitation, a storage vessel containing gaseous fire suppressant, an inert gas generator (e.g., a nitrogen generation system), and the like. The fire-suppression agent may comprise, for example but without limitation, gaseous chemical agents such as: HFC-125 or Pentafluoroethane ($CF_3CHF_2$); inert gases and semi-inert gases such as Nitrogen, Argon or Helium; aerosolized liquid mists such as 3M™ NOVEC™ 1230 fire protection fluid ($C_6F_{12}O$) (commercially available from 3M) or water ($H_2O$); Halon; a mixture thereof; and the like.

The fire-suppression agent flow-control valve 312 is coupled to the fire-suppression agent supply source 310 and the plumbing connection 314. The fire-suppression agent flow-control valve 312 controls flow of fire-suppression agent from the fire-suppression agent supply source 310 into the plumbing connection 314. The fire-suppression agent flow-control valve 312 is configured to be in an open state or a closed state depending on presence or absence of fire respectively. The fire-suppression agent flow-control valve 312 may comprise, for example but without limitation, a ball valve, a butterfly valve, and the like. The fire-suppression agent flow-control valve 312 may be actuated, for example but without limitation, electronically, via an actuator, via a gear mechanism, in conjunction with one or more components of the system 300, and the like. An actuator known to those skilled in the art may be used for actuation of the fire-suppression agent flow-control valve 312, for example but without limitation, a hydraulic actuator, a piezoelectric actuator, a spring-loaded mechanism tied to fire-suppression agent flow-control valve 312, and the like. In an embodiment, the fire-suppression agent flow-control valve 312 comprises a pyrotechnic valve. A pyrotechnic is a valve that opens due to a combustive process and remains open until maintenance replaces the valve. An advantage of the pyrotechnic valve is durability and reliability, and an ability to reliably contain a high pressure for substantially long periods of time until opened.

The plumbing connection 314 is coupled to the fire-suppression agent flow-control valve 312 and the duct system 306. The plumbing connection 314 transports flow of fire-suppression agent from the fire-suppression agent flow-control valve 312 into the duct system 306. The plumbing connection 314 may comprise, for example but without limitation, metal pipe, plastic pipe, composite pipe, and the like. The plumbing connection 314 is configured to direct a flow of fire-suppression agent from the fire-suppression agent flow-control valve 312 to the duct system 306. The plumbing connection 314 may comprise a flow regulator (not shown) to regulate a flow of fire-suppression agent to a flow rate having a pressure suitable for flowing through the duct system 306.

The fire detector 316 is coupled by an electrical and/or optical signal to the controller 318 and configured to detect fire conditions. The fire detector 316 may comprise a device for detecting fire, such as but without limitation, a smoke sensor, a heat sensor, an infrared sensor, and the like.

The controller 318 is coupled by an electrical and/or optical signal to the fire detector 316, the conditioned air shut-off valve 304, and the fire-suppression agent flow-control valve 312. The controller 318 is configured to manage/control the conditioned air shut-off valve 304 and the fire-suppression agent flow-control valve 312 in accordance with embodiments described herein. The controller 318 may be implemented as, for example but without limitation, part of an aircraft-computing module, a centralized aircraft processor, a subsystem-computing module devoted to the dual-mode conditioned air/fire-suppression agent distribution system 300, and the like. The controller 318 may be, for example but without limitation, a softwarecontrolled device, electronic, mechanical, electro-mechanical, fluidic, and the like. The controller 318 may be activated, for example but without limitation, automatically, manually, a combination thereof, and the like. The controller 318 may receive signals indicative of presence or absence of fire in the cargo volume 504 (FIG. 5) from the fire detector 316.

In an embodiment, the controller 318 sends a signal to the conditioned air shut-off valve 304 to close or open the conditioned air shut-off valve 304. For example, if the fire detector 316 detects a fire/smoke in the cargo volume 504, the controller 318 sends a fire-warning signal to an actuator mechanism (not shown) of the conditioned air shut-off valve 304 commanding the conditioned air shut-off valve 304 to close. In this manner, the conditioned air shut-off valve 304 changes from an open position to a closed position thereby blocking the flow of conditioned air through the duct system 306. Substantially simultaneously, the controller 318 sends the fire-warning signal to the fire-suppression agent flow-control valve 312, for example via an actuator (not shown), which changes from a closed position to an open position allowing the fire-suppression agent to flow to and through the plumbing connection 314 and into the duct system 306.

In an embodiment, when the fire is suppressed, the controller 318 sends a fire-suppressed signal to the conditioned air shut-off valve 304 and to the fire-suppression agent flow-control valve 312. In this manner, the conditioned air shut-off valve 304 changes from the closed position to the open position, thereby unblocking the flow of conditioned air to the duct system 306. In addition, in this manner the fire-suppression agent flow-control valve 312 changes from the open position to the closed position stopping fire-suppression agent flow to the duct system 306.

In an embodiment, the fire-warning signal and the fire-suppressed signal may be sent to a control panel (not shown) such as a cockpit control panel. In this manner, an operator such as a pilot or another flight crewmember can activate the controller 318 manually via a switch, and the like, to remotely open and/or close the conditioned air shut-off valve 304 and the fire-suppression agent flow-control valve 312 accordingly.

The system 300 allows delivery of low or high volumetric flow rates of fire-suppression agent into a contained volume, such as but without limitation, a cargo bay, a cargo compartment, and the like. The system 300 delivers low or high volumetric flow rates of fire-suppression agent into the contained volume from a remotely located agent supply such as the fire-suppression agent supply source 310 via the duct system 306 without having a separate dedicated distribution system in addition to a cargo ventilation system. The system 300 has dual operation modes. During non-fire-emergency operation, the system 300 allows conditioned air to flow into the contained volume to provide heating, cooling or ventilation. In an event of a fire, the system 300 ceases ventilation and transports fire-suppression agent to the contained volume.

Figure 4:
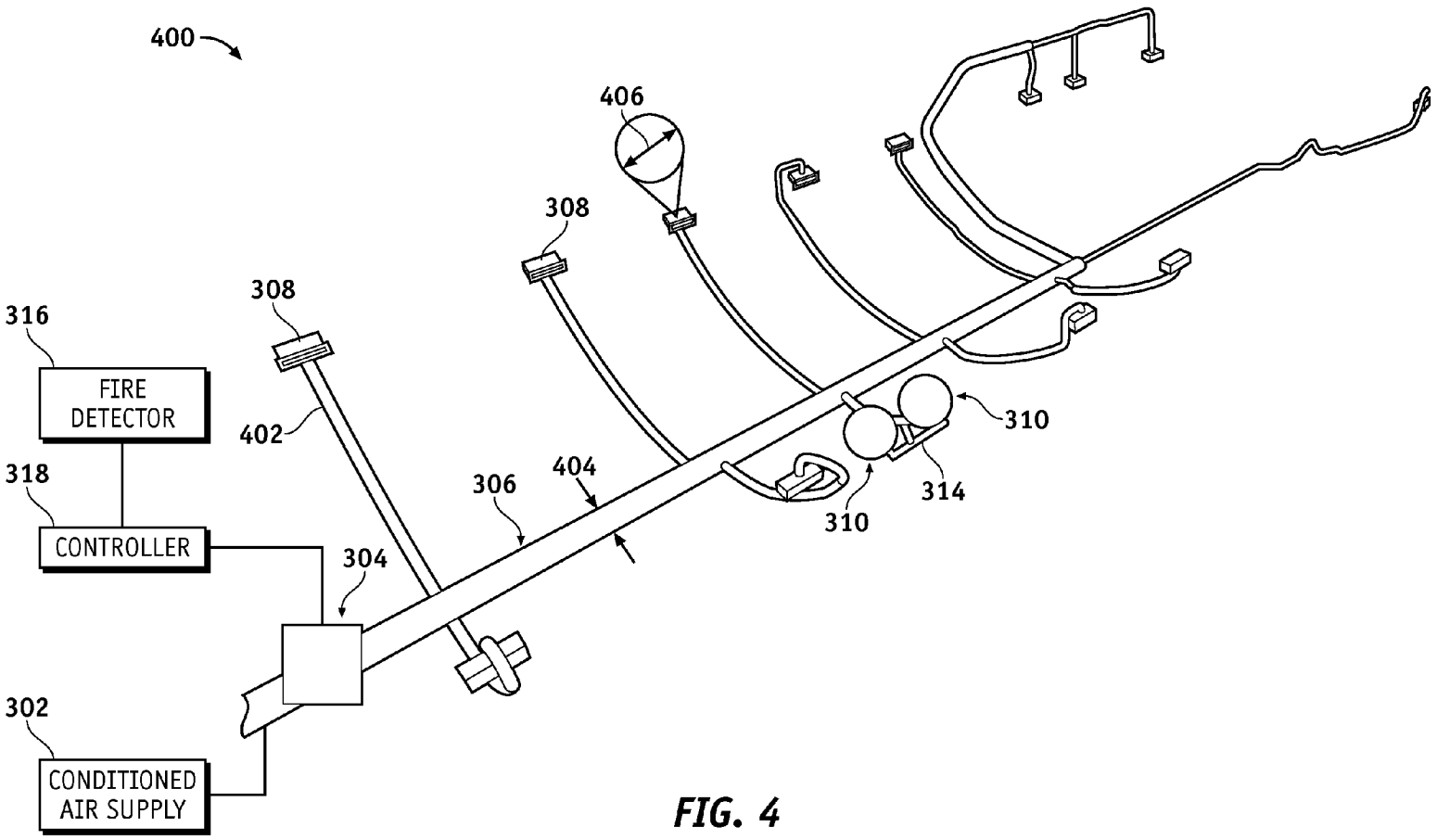
FIG. 4 is an illustration of an exemplary structure of a dual-mode conditioned air/fire-suppression agent distribution system according to an embodiment of the disclosure.

FIG. 4 is an illustration of an exemplary structure 400 of a dual-mode conditioned air/fire-suppression agent distribution system according to an embodiment of the disclosure. The structure 400 may have functions, materials, and structures that are similar to the embodiments shown in FIG. 3. Therefore common features, functions, and elements may not be redundantly described here. The structure 400 comprises the conditioned air supply source 302, the conditioned air shut-off valve 304, the duct system 306, the one or more distribution nozzles 308, the at least one fire-suppression agent supply source 310, the fire-suppression agent flow-control valve 312 (not shown in FIG. 4), the plumbing connection 314, the fire detector 316, and the controller 318. A shape of ducts of the duct system 306 may be, for example but without limitation, cylindrical with an outer diameter 404 of, for example but without limitation, about 2 inches to about 3 inches, and the like. A shape of the distribution nozzles 308 may be, for example but without limitation, circular having a diameter 406 ranging from, for example but without limitation, about 2 inches to about 7.5 inches, and the like. A shape of the distribution nozzles 308 may be also be, for example but without limitation, elliptical, rectangular, and the like. The duct system 306 may be coupled radially to the distribution nozzles 308 via a branch duct 402.

FIG. 5 is an illustration of an exemplary structure 500 of an aircraft cargo volume comprising the dual-mode conditioned air/fire-suppression agent distribution system 400 according to an embodiment of the disclosure. The structure 500 may have functions, material, and structures that are similar to the embodiments shown in FIGS. 3-4. Therefore common features, functions, and elements may not be redundantly described here. The structure 500 comprises, an aircraft fuselage 502 enclosing a forward cargo volume 504 comprising the dual-mode conditioned air/fire-suppression agent distribution system 400.

In an embodiment, a cargo volume may comprise multiple cargo bays. For example, the structure 500 may comprise an aft cargo volume (not shown) separated by aircraft wings (not shown) from the forward cargo volume 504 in addition to the forward cargo volume 504. With two or more cargo bays, the dual-mode conditioned air/fire-suppression agent distribution system 400 is operable to suppress one or more fires whether in the forward cargo volume 504 and/or the aft cargo volume.

In the embodiment shown in FIG. 5 the duct system 306 may be located substantially near the cargo floor 510 at a distance 514 from the ceiling 516. Each branch duct 402 may extend radially from the duct system 306 to any location suitable for operation of the structure 500, for example but without limitation, at least a portion of: the left-side wall 512, the right-side wall (not shown), both the left-side wall 512 and the right-side wall, a front wall (not shown), a back wall (not shown), a hallway (not shown), a compartment coupled to the cargo volume 504 (not shown), a plurality of walls, the ceiling 516, the cargo floor 510, a combination thereof, and the like. The one or more fire-suppression agent supply source 310 may be installed, for example but without limitation, outside a right-side wall (not shown), and the like. Distribution nozzles 308 may be installed, for example but without limitation, in a liner (not shown) of the left-sidewall 512, the right-side wall on a side of the forward cargo volume 504, on the ceiling 516, in the cargo floor 510, and the like. The structure 500 avoids extra weight required for carrying a dedicated fire-suppression agent system for a rare fire event, while retaining the fire-suppression capability, thereby saving fuel during general aircraft operations.

Figure 6:
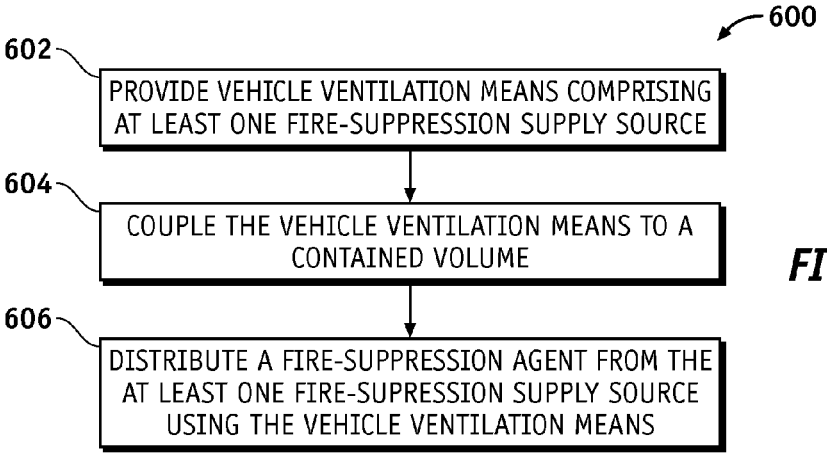
FIG. 6 is an illustration of an exemplary flow chart showing a dual-mode conditioned air/fire-suppression agent distribution process according to an embodiment of the disclosure.
Figure 7:
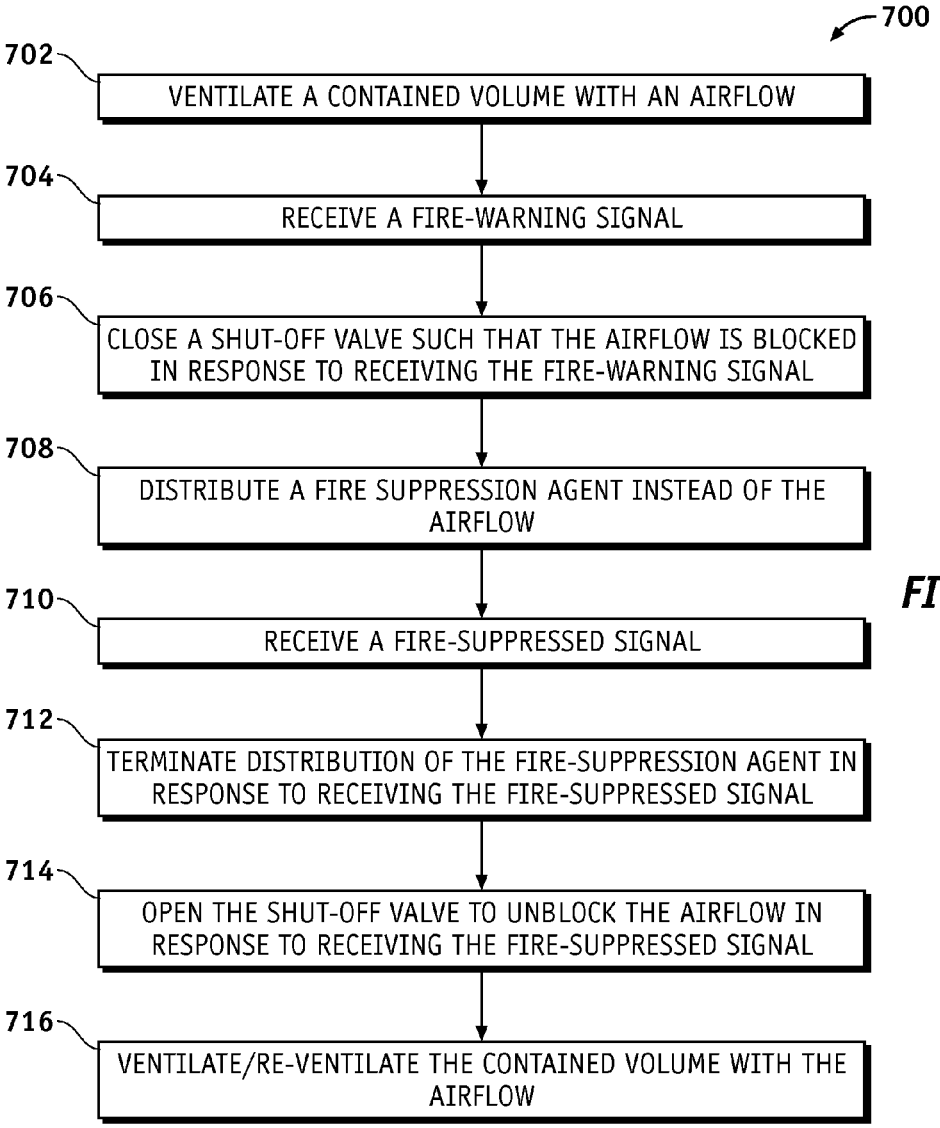
FIG. 7 is an illustration of an exemplary flow chart showing a dual-mode conditioned air/fire-suppression agent distribution process according to an embodiment of the disclosure.

FIGS. 6-7 are illustrations of two exemplary flow charts showing dual-mode conditioned air/fire-suppression agent distribution processes 600-700 according to two embodiment of the disclosure. The various tasks performed in connection with processes 600-700 may be performed mechanically, by software, hardware, firmware, or any combination thereof. For illustrative purposes, the following description of processes 600-700 may refer to elements mentioned above in connection with FIGS. 1-5. In practical embodiments, portions of the processes 600-700 may be performed by different elements of the dual-mode conditioned air/fire-suppression agent distribution system 300-500 such as: the conditioned air supply source 302, the conditioned air shut-off valve 304, the duct system 306, the one or more distribution nozzles 308, the at least one fire-suppression agent supply source 310, the fire-suppression agent flow-control valve 312, the plumbing connection 314, the fire detector 316, and the controller 318. Processes 600-700 may have functions, material, and structures that are similar to the embodiments shown in FIGS. 1-5. Therefore common features, functions, and elements may not be redundantly described here.

FIG. 6 is an illustration of an exemplary flow chart showing the dual-mode conditioned air/fire-suppression agent distribution process 600 according to an embodiment of the disclosure.

Process 600 may begin by providing vehicle ventilation means comprising at least one fire-suppression supply source (task 602). As mentioned above, the vehicle ventilation means may comprise a heating system, an air-conditioning system, and the like, suitable for operation of the embodiments of the dual-mode conditioned air/fire-suppression agent distribution system described herein.

Process 600 may then continue by coupling the vehicle ventilation means to a contained volume (task 604). The contained volume such as the cargo volume 504 may comprise, for example but without limitation, a cargo bay an unoccupied aircraft cargo hold, and the like.

Process 600 may then continue by distributing a fire suppression agent from the at least one fire suppression supply source using the vehicle ventilation means (task 606).

FIG. 7 is an illustration of an exemplary flow chart showing the dual-mode conditioned air/fire-suppression agent distribution process 700 according to an embodiment of the disclosure.

Process 700 may begin by ventilating a contained volume (e.g., cargo volume 504) with an airflow (task 702).

Process 700 may then continue by the controller 318 receiving a fire-warning signal (task 704) from the fire detector 316.

Process 700 may then continue by closing the conditioned air shut-off valve 304 to block the airflow in response to the controller 318 receiving the fire-warning signal (task 706). When the controller 318 receives the fire-warning signal, the controller 318 sends a command signal to an actuation mechanism commanding a closed state where the conditioned air shut-off valve 304 is closed. In this manner, the conditioned air shut-off valve 304 prevents the fire-suppression agent from flowing into, for example but without limitation, a passenger bay, a duct system for an occupied area, and the like. In addition, the conditioned air shut-off valve 304 prevents the conditioned air, comprising fresh air, from flowing into the cargo bay during a fire event. Restricting conditioned air with its oxygen from the contained volume enhances fire suppression.

Process 700 may then continue by distributing a fire suppression agent instead of the airflow substantially throughout the contained volume (task 708). As mentioned above, the contained volume may comprise, for example but without limitation, a cargo bay, an unoccupied contained volume, a combination thereof, and the like.

Process 700 may then continue by the controller 318 receiving a fire-suppressed signal (task 710) from the fire detector 316.

Process 700 may then continue by terminating distribution of the fire-suppression agent in response to the controller 318 receiving the fire-suppressed signal (task 712).

Process 700 may then continue by opening the conditioned air shut-off valve 304 to unblock the airflow in response to the controller 318 receiving the fire-suppressed signal (task 714). The controller 318 receives the fire-suppressed signal from the fire detector 316 and sends a command signal to the actuation mechanism to command an open state where the conditioned air shut-off valve 304 is opened.

Process 700 may then continue by ventilating/re-ventilating the contained volume with the airflow (task 716).

In this way, various embodiments of the disclosure provide a method for conditioning air, or suppressing fire using a signal dual-mode system, thereby saving weight, volume, and installation time. In this manner, complexity and cost for the cargo-fire suppression system is significantly reduced. Furthermore, the embodiments allow significantly greater volumetric flow rates than the existing Halon-type systems, which would have to be increased in size and weight to accommodate environmentally friendly fire suppression agents.

While at least one example embodiment has been presented in the foregoing detailed description, it should be appreciated that a vast number of variations exist. It should also be appreciated that the example embodiment or embodiments described herein are not intended to limit the scope, applicability, or configuration of the subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 3-5 depict example arrangements of elements, additional intervening elements, devices, features, or components may be present in an embodiment of the disclosure.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The invention claimed is:

1. An aircraft integrated cargo fire-suppression agent distribution system, comprising:

a conditioned air supply source;

a cargo compartment enclosed within an interior space of an aircraft body;

a passenger compartment separated from the cargo compartment;

at least one fire-suppression agent supply source;

a duct system coupling both (i) the conditioned air supply source to the cargo compartment and (ii) the at least one fire-suppression agent supply source to the cargo compartment;

a conditioned air shut-off valve coupled to the conditioned air supply source;

a fire-suppression agent flow-control valve coupled to (i) the at least one fire-suppression agent supply source and (ii) a plumbing connection, wherein the plumbing connection is coupled to the duct system; and a controller, wherein the system consists of a dual-mode conditioned air/fire-suppression agent distribution system, wherein the controller controls the conditioned air shut-off valve and the fire-suppression agent flow-control valve such that only one of the conditioned air shut-off valve and the fire-suppression agent flow-control valve is open at any given time, wherein the controller commands a closed state in response to receiving a fire-warning signal, wherein the conditioned air shut-off valve is closed in the closed state to thereby block the flow of the conditioned air to the cargo compartment, and wherein the fire-suppression agent flow-control valve is opened in the closed state to thereby allow distribution of a fire-suppression agent from the at least one fire-suppression agent supply source to the cargo compartment via the duct system.

2. The aircraft integrated cargo fire-suppression agent distribution system according to claim 1, wherein the duct system is coupled to an aircraft.

3. The aircraft integrated cargo fire-suppression agent distribution system according to claim 1, wherein the fire-suppression agent suppresses a fire within the cargo compartment.

4. The aircraft integrated cargo fire-suppression agent distribution system according to claim 3, wherein the conditioned air comprises oxygen and is blocked from flowing to the cargo compartment thereby enhancing fire suppression in the contained volume.

5. The aircraft integrated cargo fire-suppression agent distribution system according to claim 1, wherein the controller is further operable to command an open state in response to receiving a fire-suppressed signal, wherein the conditioned air shut-off valve is opened in the open state to thereby unblock the airflow and allowing ventilation with the airflow via the duct system, and wherein the fire-suppression agent flow-control valve is closed in the open state to thereby block distribution of the fire-suppression agent from the at least one fire-suppression agent supply source to the cargo compartment.

6. The aircraft integrated cargo fire-suppression agent distribution system according to claim 1, wherein the fire-suppression agent comprises: an inert gas with a high volumetric flow rate in an order of about 2000-3000 cubic feet per minute for an approximate 5000 cubic foot compartment volume.

7. The aircraft integrated cargo fire-suppression agent distribution system according to claim 1, wherein the fire-suppression agent comprises: Halon with a low volumetric flow rate of about 150 cubic feet per minute.

8. An integrated cargo fire-suppression agent distribution method, comprising:

coupling an air supply source to a cargo compartment via a duct system through a conditioned air shut-off valve, wherein the cargo compartment is enclosed within an interior space of an aircraft body, and wherein the cargo compartment is separated from a passenger compartment;

coupling at least one fire-suppression supply source to the cargo compartment via the duct system through a fire-suppression agent flow-control valve, wherein the fire-suppression agent flow-control valve is coupled to (i) the at least one fire-suppression agent supply source and (ii) a plumbing connection, wherein the plumbing connection is coupled to the duct system; and configuring the duct system to distribute a fire-suppression agent to the cargo compartment from the at least one fire-suppression supply source without using a separate dedicated distribution system in addition to the duct system when a controller commands a closed state in response to receiving a fire-warning signal, wherein the shut-off valve is closed in the closed state to thereby block the airflow to the cargo compartment, wherein the fire-suppression agent flow-control valve is opened in the closed state to thereby allow distribution of the fire-suppression agent from the at least one fire-suppression agent supply source to the cargo compartment via the duct system, wherein the system consists of a dual-mode conditioned air/fire-suppression agent distribution system, and wherein the controller controls the conditioned air shut-off valve and the fire-suppression agent flow-control valve such that only one of the conditioned air shut-off valve and the fire-suppression agent flow-control valve is open at any given time.

9. The integrated cargo fire-suppression agent distribution method according to claim 8, further comprising configuring the duct system to distribute an inert gas.

10. An integrated cargo fire-suppression agent distribution method, the method comprising:

closing a conditioned air shut-off valve coupled to a conditioned air supply source such that an airflow of conditioned air from the conditioned air supply source is blocked in a duct system thereby blocking flow of the conditioned air, wherein the duct system couples both (i) the conditioned air supply source to a cargo compartment, and (ii) at least one fire-suppression agent supply source to the cargo compartment, wherein the cargo compartment is enclosed within an interior space of an aircraft body, wherein the cargo compartment is separated from a passenger compartment, and wherein the duct system is coupled to the at least one fire-suppression agent supply source through a fire-suppression agent flow-control valve and a plumbing connection, wherein the plumbing connection is coupled to the duct system; and distributing a fire-suppression agent instead of the airflow to the cargo compartment using the duct system without using a separate dedicated distribution system in addition to the duct system when a controller commands a closed state in response to receiving a fire-warning signal, wherein the conditioned air shut-off valve is closed in the closed state to thereby block the flow of the conditioned air to the cargo compartment from the conditioned air supply source, wherein the fire-suppression agent flow-control valve is opened in the closed state to thereby allow distribution of the fire-suppression agent from the at least one fire-suppression agent supply source to the cargo compartment via the duct system, wherein the system consists of a dual-mode conditioned air/fire-suppression agent distribution system, and wherein the controller controls the conditioned air shut-off valve and the fire-suppression agent flow-control valve such that only one of the conditioned air shut-off valve and the fire-suppression agent flow-control valve is open at any given time.

11. The integrated cargo fire-suppression agent distribution method according to claim 10, further comprising opening the conditioned air shut-off valve in response to receiving a fire-suppressed signal such that the airflow is unblocked.

12. The integrated cargo fire-suppression agent distribution method according to claim 10, further comprising:

ventilating the cargo compartment with the airflow;

terminating distribution of the fire-suppression agent; and re-ventilating the cargo compartment with the airflow.

13. The integrated cargo fire-suppression agent distribution method according to claim 10, wherein distribution of the fire-suppression agent is terminated in response to receiving a fire-suppressed signal.

14. The integrated cargo fire-suppression agent distribution method according to claim 10, further comprising distributing the fire-suppression agent instead of the airflow to the cargo compartment, the fire-suppression agent comprising at least one of the group consisting of: gaseous chemical agents, an inert gas, a semi-inert gas, aerosolized liquid mists, and Halon.

15. The integrated cargo fire-suppression agent distribution method according to claim 10, wherein the fire-suppression agent comprises: HFC-125, Pentafluoroethane ($CF_3CHF_2$), Nitrogen, Argon, Helium, aerosolized liquid mist, fire protection fluid ($C_6F_{12}O$), water, Halon, or a mixture thereof.

* * * * *